US008358265B2

(12) United States Patent
Kobiki et al.

(10) Patent No.: US 8,358,265 B2
(45) Date of Patent: Jan. 22, 2013

(54) IMAGE DISPLAY APPARATUS

(75) Inventors: Hisashi Kobiki, Kawasaki (JP); Masahiro Baba, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 13/417,727

(22) Filed: Mar. 12, 2012

(65) Prior Publication Data

US 2012/0169796 A1 Jul. 5, 2012

Related U.S. Application Data

(63) Continuation of application No. PCT/JP2009/066435, filed on Sep. 18, 2009.

(51) Int. Cl.
*G09G 3/36* (2006.01)

(52) U.S. Cl. ..... 345/102; 345/690; 345/204

(58) Field of Classification Search ..... 345/87, 345/98, 99, 100, 101, 102, 204, 690, 211, 345/212

See application file for complete search history.

(56) References Cited

U.S. PATENT DOCUMENTS

| | | | | |
|---|---|---|---|---|
| 7,605,828 | B2 * | 10/2009 | Childers | 345/690 |
| 7,623,105 | B2 * | 11/2009 | Li et al. | 345/88 |
| 2010/0054623 | A1 | 3/2010 | Kobiki et al. | |
| 2010/0123696 | A1 | 5/2010 | Kobiki et al. | |

FOREIGN PATENT DOCUMENTS

| | | |
|---|---|---|
| JP | 2006-285064 | 10/2006 |
| JP | 2008-262226 | 10/2008 |
| WO | WO 2007/060783 A1 | 5/2007 |

OTHER PUBLICATIONS

International Preliminary Report on Patentability and Written Opinion issued by the International Bureau of WIPO on Apr. 11, 2012, in International Application No. PCT/JP2009/066435.

English-language International Search Report from the Japanese Patent Office in International Application No. PCT/JP2009/066435 mailed Nov. 17, 2009.

* cited by examiner

*Primary Examiner* — Duc Dinh

(74) *Attorney, Agent, or Firm* — Finnegan, Henderson, Farabow, Garrett & Dunner, L.L.P.

(57) ABSTRACT

There is provided an image display apparatus that corrects the gradation of an input video signal in accordance with an ambient illuminance, in which the adaptation amount of the eye and a surface reflection amount are calculated based on an illuminance signal acquired through a sensor, and the screen luminance of the screen and the gamma conversion for the video signal are controlled based on the adaptation amount of the eye and the surface reflection amount.

4 Claims, 14 Drawing Sheets

| GRADATION VALUE x | BRIGHTNESS R(x) 80 lx, 100 cd/m² |
|---|---|
| 1 | 0.048697 |
| 1 | 0.048729 |
| 2 | 0.048845 |
| 3 | 0.049057 |
| | |
| 252 | 0.390016252 |
| 253 | 0.391321253 |
| 254 | 0.392622254 |
| 255 | 0.393921255 |

CONVETIONAL ART

EMBODIMENT

| AMBIENT ILLUMINANCE (lx) | LIGHT MODULATION SIGNAL ($cd/m^2$) |
|---|---|
| 80 | 100 |
| 150 | 125.89 |
| 300 | 160.95 |
| 600 | 204.23 |
| | |
| 3000 | 346.28 |
| 5000 | 406.58 |
| 7000 | 451.01 |
| 9000 | 486.7 |

FIG. 14

| | OUTPUT GRADATION | | | | |
|---|---|---|---|---|---|
| INPUT GRADATION | AMBIENT ILLUMINANCE 1000(lx) | AMBIENT ILLUMINANCE 3000(lx) | AMBIENT ILLUMINANCE 5000(lx) | AMBIENT ILLUMINANCE 7000(lx) | AMBIENT ILLUMINANCE 9000(lx) |
| 0 | 19 | 11 | 0 | 0 | 0 |
| 1 | 19 | 11 | 0 | 0 | 0 |
| 2 | 19 | 12 | 0 | 0 | 0 |
| 3 | 20 | 12 | 0 | 0 | 0 |
| 4 | 20 | 13 | 0 | 0 | 0 |
| 5 | 21 | 15 | 0 | 0 | 0 |
| 6 | 22 | 16 | 0 | 0 | 0 |
| 7 | 23 | 18 | 0 | 0 | 0 |
| 8 | 24 | 19 | 0 | 0 | 0 |
| 9 | 25 | 21 | 8 | 0 | 0 |
| 10 | 26 | 23 | 13 | 0 | 0 |
| 11 | 27 | 24 | 16 | 0 | 0 |
| 12 | 28 | 26 | 19 | 0 | 0 |
| 13 | 29 | 27 | 21 | 8 | 0 |
| 14 | 31 | 29 | 23 | 14 | 0 |
| 15 | 32 | 31 | 26 | 18 | 0 |
| | | | | | 0 |
| 240 | 242 | 242 | 242 | 242 | 242 |
| 241 | 242 | 243 | 243 | 243 | 243 |
| 242 | 243 | 243 | 243 | 243 | 243 |
| 243 | 244 | 244 | 244 | 244 | 244 |
| 244 | 245 | 245 | 245 | 245 | 245 |
| 245 | 246 | 246 | 246 | 246 | 246 |
| 246 | 247 | 247 | 247 | 247 | 247 |
| 247 | 248 | 248 | 248 | 248 | 248 |
| 248 | 249 | 249 | 249 | 249 | 249 |
| 249 | 250 | 250 | 250 | 250 | 250 |
| 250 | 251 | 251 | 251 | 251 | 251 |
| 251 | 251 | 252 | 252 | 252 | 252 |
| 252 | 252 | 252 | 252 | 252 | 252 |
| 253 | 253 | 253 | 253 | 253 | 253 |
| 254 | 254 | 254 | 254 | 254 | 254 |
| 255 | 255 | 255 | 255 | 255 | 255 |

FIG. 15

IMAGE DISPLAY APPARATUS

CROSS REFERENCE TO RELATED APPLICATIONS

This application is a continuation of International Application No. PCT/JP2009/066435, filed on Sep. 18, 2009, the entire contents of which is hereby incorporated by reference.

FIELD

Embodiments relate to an image display apparatus, and for example, relate to a technique for improving visual contrast and gradation in a display video image in a viewing circumstance where the illuminance changes suddenly.

BACKGROUND

In recent years, image display apparatuses such as liquid crystal display apparatuses each including a light source and a light modulation device to modulate the intensity of light from the light source have been widely spread. In these image display apparatuses, however, the degree of adaptation of the human eye (hereinafter referred to as the "adaptation amount of the eye") to the light intensity in the surroundings of each image display apparatus is not taken into consideration.

In general, the adaptation amount of the eye becomes larger as the ambient illuminance becomes higher, and becomes smaller as the ambient illuminance becomes lower. Also, the differences in luminance between bright objects are more easily recognized where the adaption amount of the eye is larger, and the differences in luminance between dark objects are more easily recognized where the adaptation amount of the eye is smaller. Therefore, when the illuminance in a circumstance where an image display apparatus is viewed suddenly changes, the visual contrast and gradation appear to be lower, though there are no changes in the display characteristics of the image display apparatus.

To restrain such decreases in visual contrast and gradation, there has been a suggested method by which modulation of the luminance of the light source, and a gradation conversion for the respective pixels of an input video image (i.e., a gamma conversion) are performed in accordance with the adaptation amount of the eye.

For example, according to JP-A 2006-285064, when the illuminance suddenly becomes lower, the adaptation amount of the eye is calculated through a predetermined low pass filter operation, and modulation of the luminance of the light source and the gamma conversion are collectively performed in accordance with the adaptation amount of the eye.

However, if the illuminance in a circumstance where an image display apparatus is viewed becomes higher, the illuminance of light incident on the display screen of the image display apparatus becomes higher, resulting in decreases in visual contrast and gradation due to surface reflection. Also, the temporal changes in visual contrast and gradation with respect to the change in the illuminance at this point are much sharper than temporal changes due to adaptation of the eye.

In JP-A 2006-285064, such decreases and temporal changes in visual contrast and gradation due to surface reflection are not taken into consideration. Therefore, after the light intensity in the surroundings changes suddenly, images with improper contrast and gradation are displayed for a while.

BRIEF DESCRIPTION OF THE DRAWINGS

FIG. 14 shows a table that is stored in the adaptation control unit according to the third embodiment; and FIG. 15 shows a table that is stored in the adaptation control unit according to the third embodiment.

DETAILED DESCRIPTION

There is provided an image display apparatus including an image display unit, a backlight unit, an illuminance detecting unit, an adaptation calculating unit, a surface reflection calculating unit an adaptation control unit, a screen luminance setting unit and a signal processing unit.

The image display unit displays an image on a display screen.

The illuminance detecting unit detects an ambient illuminance of the image display unit.

The backlight unit emits a light.

The adaptation calculating unit calculates an adaptation amount of an eye, based on the ambient illuminance.

The surface reflection calculating unit calculates a light reflection luminance on the display area, based on the ambient illuminance.

The adaptation control unit includes the first luminance calculating unit and the second luminance calculating unit.

The first luminance calculating unit calculates ideal gradation luminance for a plurality of gradations, respectively, based on the adaptation amount of the eye, the ideal gradation luminance being indicative of display luminance necessary to achieve predetermined brightness at the ambient illuminance.

The second luminance calculating unit calculates a first screen luminance being a screen luminance to be set on the backlight unit, based on the reflection luminance.

The luminance setting unit sets a light luminance based on the first screen luminance.

The signal processing unit converts gradations of an input video signal based on differences between the reflection luminance and the ideal gradation luminance corresponding to the gradations.

The image display unit displays an image, based on the video signal converted by the signal processing unit.

The back light unit emits light in accordance with the first screen luminance.

Hereinafter, embodiments will be described with reference to the accompanying drawings.

First Embodiment

Referring to FIGS. 1 through 7, an image display apparatus according to a first embodiment is described below.

(1) Structure of Image Display Apparatus 10

Figure 1:
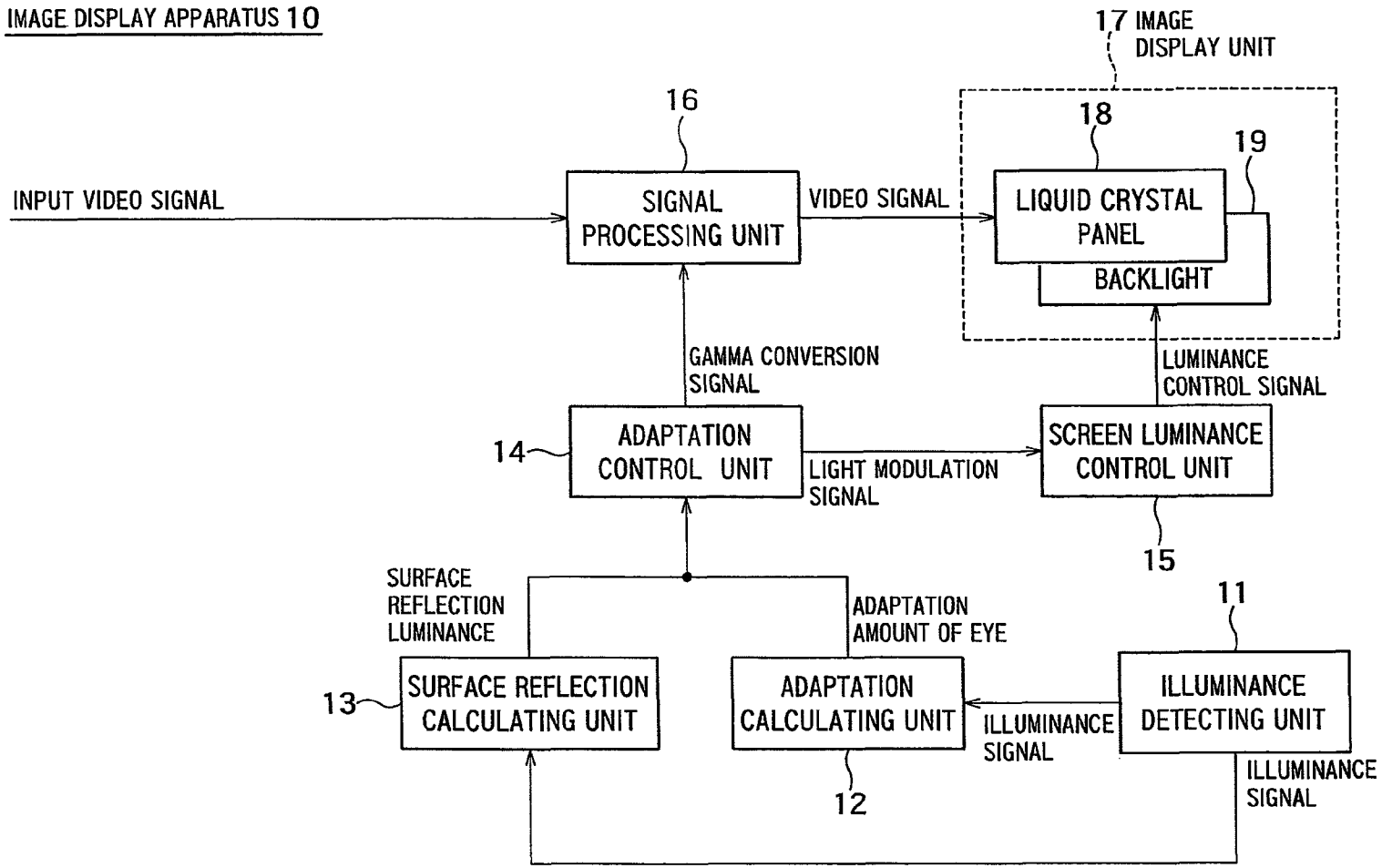
FIG. 1 is a block diagram showing the structure of an image display apparatus according to a first embodiment.

FIG. 1 shows the structure of an image display apparatus 10 according to this embodiment.

The image display apparatus 10 includes an illuminance detecting unit 11, an adaptation calculating unit 12, a surface reflection calculating unit 13, an adaptation control unit (a first luminance calculating unit and a second luminance calculating unit) 14, a screen luminance control unit (a screen luminance setting unit) 15, a signal processing unit 16, and an image display unit 17. The image display unit 17 is a liquid crystal display unit that includes a liquid crystal panel 18 serving as a light modulating device, and a backlight 19 serving as a light source unit positioned on the back side of the liquid crystal panel 18. However, the image display unit 17 is not necessarily the liquid crystal display unit, but may be an organic EL display unit, a plasma display unit, or a projector.

The illuminance detecting unit 11 detects the illuminance of light entering the image display unit 17 at predetermined intervals (every 1 frame, for example) with an illuminance sensor attached to a portion in the vicinity of the image display unit 17. When detecting an illuminance change that is equal to or larger than a predetermined threshold value, the illuminance detecting unit 11 inputs an illuminance signal indicative of the illuminance after the change, to the adaptation calculating unit 12 and the surface reflection calculating unit 13 as an ambient illuminance. The illuminance sensor can be positioned at any location, for example, on the display panel surface. More than one illuminance sensor may be provided at different locations.

Using the illuminance signal output from the illuminance detecting unit 11, the adaptation calculating unit 12 calculates the amount of adaptation of the eye to an ambient illuminance, and inputs the calculated adaption amount to the adaptation control unit 14.

Using the illuminance signal input from the illuminance detecting unit 11, the surface reflection calculating unit 13 calculates the surface reflection luminance of light incident on the display surface of the image display unit 17, and inputs the calculated surface reflection luminance to the adaptation control unit 14.

Using a brightness function R(x) stored beforehand therein, the adaptation amount of the eye input from the adaptation calculating unit 12, and the surface reflection luminance input from the surface reflection calculating unit 13, the adaptation control unit 14 calculates a light modulation signal designating the emission luminance of the backlight 19 (a luminance modulation manner), and gamma conversion signals indicative of gamma conversion functions (manners) for input video signals. The adaptation control unit 14 inputs the light modulation signal to the screen luminance control unit 15, and the gamma conversion signals to the signal processing unit 16.

Using the light modulation signal input from the adaptation control unit 14, the screen luminance control unit 15 generates a backlight drive signal for actually driving and controlling the backlight 19, and inputs the generated backlight drive signal to the backlight 19.

Using the gamma conversion signals input from the adaptation control unit 14, the signal processing unit 16 performs a gamma conversion (a gradation conversion) on input video signals, and inputs the gamma-converted video signals to the liquid crystal panel 18.

The backlight 19 of the image display unit 17 emits light in accordance with the backlight drive signal input from the screen luminance control unit 15. Based on the gamma-converted video signals (corrected video signals) input from the signal processing unit 16, the liquid crystal panel 18 of the image display unit 17 modulates the light emitted from the backlight 19, to display an image on the display surface.

Figure 2:
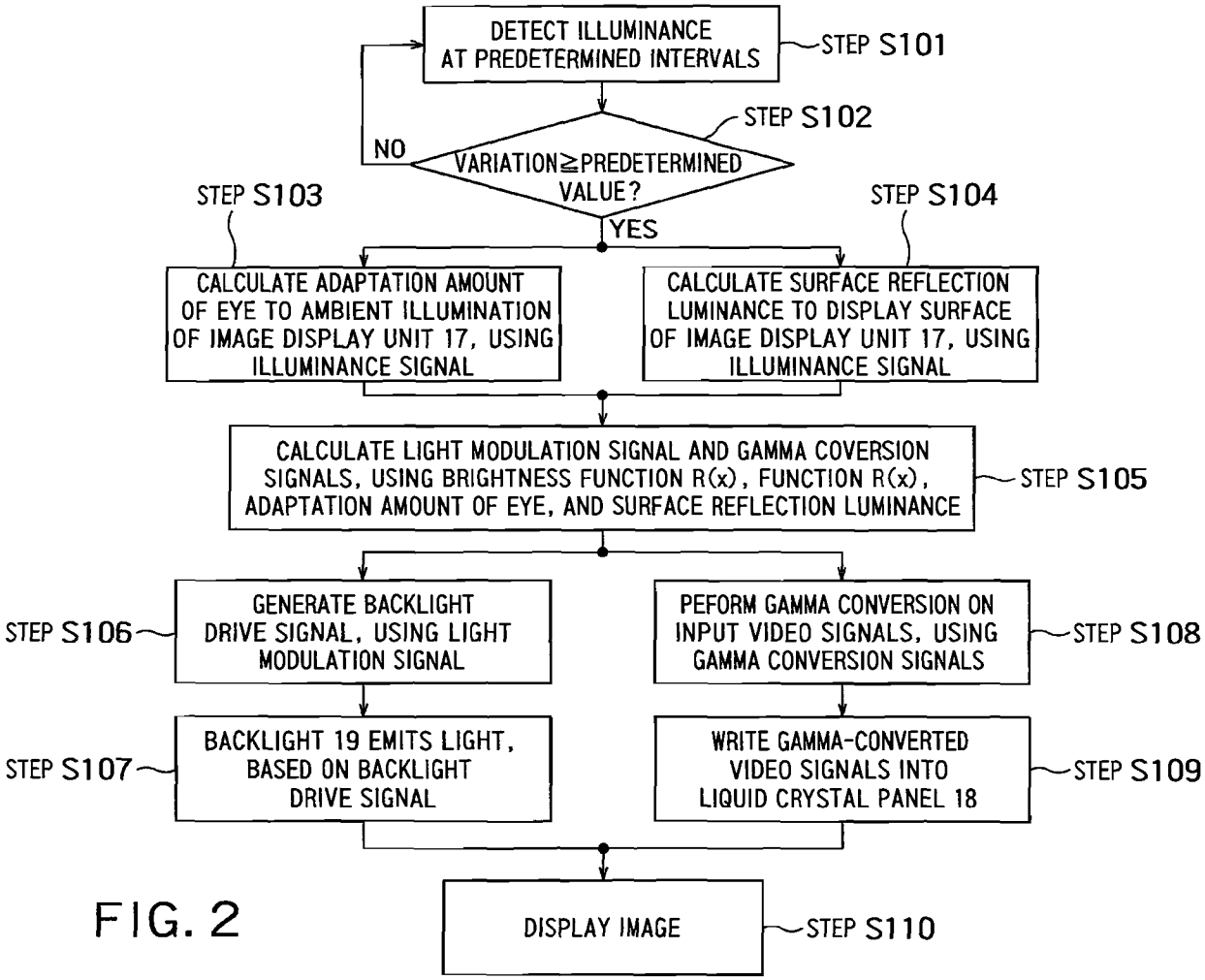
FIG. 2 is a flowchart showing operations of the first embodiment.

Referring now to FIG. 2, operations of the respective components 11 through 19 are described in detail.

FIG. 2 is a flowchart showing a flow of operations performed by the image display apparatus illustrated in FIG. 1.

(2) Illuminance Detecting Unit 11

The illuminance detecting unit 11 detects the illuminance of light entering the image display unit 17 at predetermined intervals (every 1 frame, for example) with an illuminance sensor attached to a portion in the vicinity of the image display unit 17 (step S101). When detecting an illuminance change that is equal to or larger than a predetermined value, the illuminance detecting unit 11 inputs an illuminance signal indicative of the illuminance after the change, to the adaptation calculating unit 12 and the surface reflection calculating unit 13 as an ambient illuminance (step S102).

Specifically, the illuminance of light entering the image display unit 17 is first detected at predetermined intervals. At this point, it is preferable to detect the illuminance at time intervals of "Δt" seconds, which is required for one field in a display cycle of the image display apparatus 10, or longer. That is, where the display cycle is 60 Hz, "Δt" is equal to or longer than 0.0167 second.

When an illuminance change equal to or larger than a threshold value (101 x, for example) is detected in "Δt" seconds, an illuminance signal E indicative of the illuminance after the change is transmitted. As the threshold value, the smallest possible variation width a sensor can detect may be used. When the illuminance change is smaller than the threshold value, it may be considered that there has not been an illuminance change, and an illuminance signal that is stored in an internal storage prior to the illuminance change (the illuminance signal that has been output immediately before the change) may be transmitted, or no signals may be output. In the latter case, the respective processors in the later stages may determine that the same illuminance signal as the previous illuminance signal has been input, and perform processing. Alternatively, the signal processing unit 16 and the screen luminance control unit 15 may perform the same processing (screen luminance control and gamma conversion) as that performed when the previous illuminance signal was input, and the adaptation calculating unit 12, the screen reflection calculating unit 13, and the adaptation control unit 14 may not perform any processing.

Through the above described steps S101 and S102, when a change equal to or larger than a predetermined value occurs in the ambient illuminance, the illuminance signal E after the illuminance change is input to the adaptation calculating unit 12 and the surface reflection calculating unit 13.

(3) Adaptation Calculating Unit 12

Using the illuminance signal input from the illuminance detecting unit 11, the adaptation calculating unit 12 calculates the amount of adaptation of the eye to the ambient illuminance, and inputs the calculated adaptation amount of the eye to the adaptation control unit 14 (step S103). As described above, the adaptation amount of the eye indicates the degree of adaptation of the human eye to the light intensity in the surroundings of an image display apparatus. The adaptation amount becomes larger as the ambient illuminance becomes higher, and the adaptation amount becomes smaller as the ambient illuminance becomes lower. Also, where the adaptation amount of the eye is larger, it is easier to visually recognize the differences in luminance between bright objects. Where the adaptation amount of the eye is smaller, it is easier to visually recognize the differences in luminance between dark objects. The adaptation amount σ(E) of the eye is calculated according to the following expression (1):

$$\sigma(E)=aE^{0.33}b \tag{1}$$

Here, "E" represents the illuminance signal input from the illuminance detecting unit 11, "a" is a constant that is preferably set between 60.0 and 80.0, and "b" is a constant that is preferably set between 0.5 and 1.5.

Although the adaptation amount of the eye is calculated according to the expression (1), the adaptation amount of the eye may be calculated as follows. Specifically, a table that associates illuminance intensities with adaptation amounts of the eye corresponding to the each illuminance based on the expression (1) is created in advance. Based on this table, the adaptation amount of the eye corresponding to the illuminance signal input from the illuminance detecting unit 11 is obtained.

Through the above described step S103, the adaptation amount σ(E) of the eye after the illuminance change is calculated, and is input to the adaptation control unit 14.

(4) Surface Reflection Calculating Unit 13

Using the illuminance signal input from the illuminance detecting unit 11, the surface reflection calculating unit 13 calculates the luminance of light reflection to the display surface of the image display unit 17 (surface reflection luminance), and inputs the calculated surface reflection luminance to the adaptation control unit 14 (step S104). At this point, the surface reflection luminance Lref is calculated according to the following expression (2):

$$L_{ref} = \frac{EH}{\pi} \tag{2}$$

Here, "E" represents the illuminance signal input from the illuminance detecting unit 11, and "H" represents the surface reflectance on the display surface of the image display apparatus 10 that is set between 0 and 1. At this point, "H" is preferably set beforehand at the time of shipment from the factory, but may be changed by user setting.

Although the surface reflection luminance is calculated according to the expression (2) as described above, the surface reflection luminance may be calculated as follows. Specifically, a table that associates illuminance intensities with surface reflection luminance corresponding to the each illuminance based on the expression (2) is created in advance. Based on this table, the surface reflection luminance corresponding to the illuminance signal input from the illuminance detecting unit 11 is obtained.

Through the above described step S104, the surface reflection luminance Lref is calculated, and is input to the adaptation control unit 14.

(5) Adaptation Control Unit 14

Using the brightness function R(x) stored beforehand therein, the adaptation amount of the eye input from the adaptation calculating unit 12, and the surface reflection luminance input from the surface reflection calculating unit 13, the adaptation control unit 14 calculates a light modulation signal designating the emission luminance of the backlight 19, and the gamma conversion signals designating gamma conversion functions for input video signals (step S105).

Figure 3:
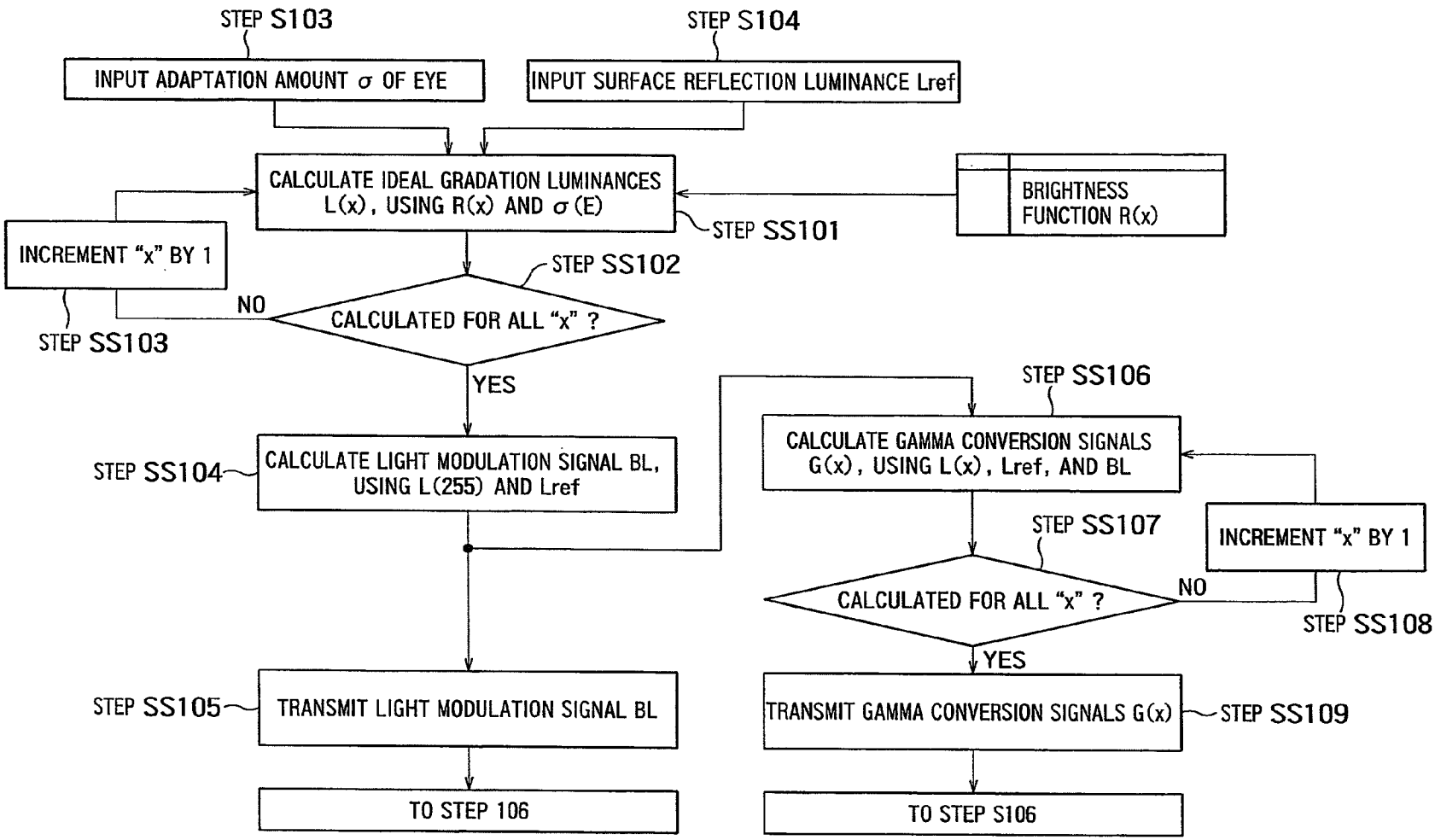
FIG. 3 is a flowchart showing operations of the adaptation control unit according to the first embodiment.

Referring now to FIG. 3, operations of the adaptation control unit 14 are described.

First, using the brightness function R(x) stored beforehand in the adaptation control unit 14, and the adaptation amount σ(E) of the eye that is output from the adaptation calculating unit 12 in step S103, the adaptation control unit 14 calculates ideal gradation luminance L(x) (step SS101).

(5-1) Brightness Function R(x)

R(x) represents a function that describes the brightness "R" of the image display unit 17 in a case where the backlight 19 of the image display apparatus 10 under a reference illuminance emits with reference screen luminance, and a gradation value "x" is input to the liquid crystal panel 18. That is, R(x) holds the correspondence between gradation values "x" and brightness "R". Hereinafter, R(x) will be referred to as the brightness function in this embodiment.

Figures 4, 5:
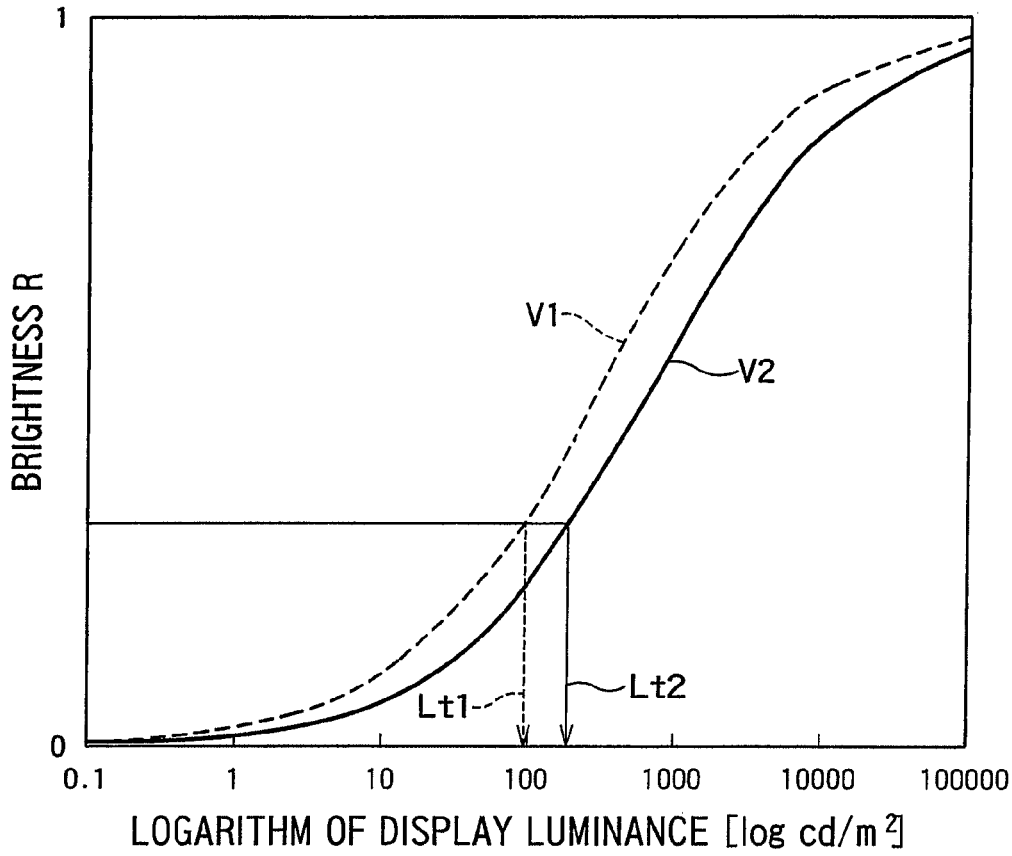
FIG. 4 is a graph showing brightness R according to the first embodiment.
FIG. 5 is a table showing a brightness function R(x) according to the first embodiment.

The brightness function R(x) holds brightness with adaptations of the human eye being taken into account. In FIG. 4, the abscissa axis indicates the display luminance "Lt" of a patch displayed on the image display apparatus 10, and the ordinate axis indicates the brightness R of the patch. At this point, the brightness "R" with respect to the display luminance "Lt" is represented by a curve V1 when the ambient illuminance is 510 lx, and is represented by a curve V2 when the ambient illuminance is 4250 lx. At this point, in V1 and V2, the display luminance Lt1 and Lt2 that achieve the same brightness "R" are a set of luminance with which the same brightness is observed in both circumstances of the ambient illuminance intensities 510 lx and 4250 lx. That is, on the basis of the brightness "R" derived from the brightness function R(x) represented by V1, an image is displayed on the image display apparatus 10 with the display luminance "Lt" cd/m$^2$ with which the same brightness "R" is achieved. Thereby, the visual contrast and the gradation in the circumstance represented by V2 where the ambient illuminance is different can be made equal to as those in the circumstance represented by V1.

In this embodiment, R(x) holds the brightness "R" with respect to respective gradation values "x" obtained where the reference screen luminance 100 cd/m$^2$ is input to the backlight 19 of the image display apparatus 10, and a total of 255 8-bit gradation values are input to the liquid crystal display panel 18, under the reference illuminance of 801 x. It should be noted that R(x) is preferably calculated and stored beforehand in an internal storage, but may also be calculated as needed in the adaptation control unit 14. As an example, a table of R(x) with respect to gradation values "x" to be input to the liquid crystal panel 18 of the image display apparatus 10 in this embodiment is shown in FIG. 5.

(5-2) Ideal Gradation Luminances (Ideal Luminances) L(x)

In this embodiment, L(x) represents the ideal luminance of a gradation value "x" required for providing the human eye with a brightness "R" in certain ambient illuminance. That is, when the ambient illuminance changes, an image is displayed on the image display apparatus 10 with the display luminance L(x) that achieves the same brightness "R" on the basis of the brightness "R" derived from the brightness function R(x). Thereby, it becomes possible to achieve the same visual contrast and gradation as those achieved in a case where the image display apparatus 10 is illuminated with the reference screen luminance of 100 cd/m$^2$ in the reference illuminance of 801 x.

An ideal gradation luminance L(x) can be calculated according to the following expression (3), which uses the brightness function R(x) stored beforehand in the adaptation control unit 14 and the adaptation amount σ(E) of the eye that is input from the adaptation calculating unit 12 in step S103:

$$L(x) = \sigma(E)\sqrt[n]{\frac{R(x)}{1 - R(x)}} \tag{3}$$

Here, "n" represents a constant that is set between 0.3 and 2.0.

A check is then made to determine whether L(x) has been calculated for all the gradations values "x" (step SS102). If the result of the determination is negative, "x" is incremented by 1 (step SS103), and L(x) is calculated for the incremented "x" (step SS101). If the result of the determination is positive, the operation moves on to the next step SS104.

Through the above described operation, ideal gradation luminance L(x) that can realize the same visual contrast and gradation as those in the reference circumstance can be calculated in a circumstance of the ambient illuminance E.

(5-3) Light Modulation Signal BL

By using L(255), which is the maximum luminance of the ideal gradation luminance L(x) calculated in steps SS101 and SS102, and the surface reflection luminance Lref, which is input from the surface reflection calculating unit 13 in step S104, the light modulation signal BL is calculated (step SS104).

The light modulation signal BL is calculated by subtracting the surface reflection luminance Lref from the maximum luminance L(255) among the ideal gradation luminance. At this point, the light modulation signal BL is calculated according to the following expression (4):

$$BL = L(255) - L_{ref} \tag{4}$$

The light modulation signal BL calculated in step SS104 is then input to the screen luminance control unit 15 (step SS105).

Through the above described steps SS101 through SS105, the light modulation signal BL for modulating the luminance of the backlight 19 is calculated and is input to the screen luminance control unit 15.

(5-4) Gamma Conversion Signals G(x)

By using the light modulation signal BL calculated in step SS104, the ideal gradation luminance L(x) calculated in steps SS101 and SS102, and the surface reflection luminance Lref input from the surface reflection calculating unit 13, gamma conversion signals (gamma conversion function) G(x) are calculated (step SS106). To calculate a gamma conversion signal G(x), a transmissive luminance is calculated by subtracting the surface reflection luminance Lref from an ideal gradation luminance L(x), and the gradation value "x" with which the transmissive luminance is to be displayed on the image display apparatus 10 with the backlight luminance BL is calculated. Each gamma conversion signal G(x) is calculated according to the following expression (5):

$$G(x) = 255\left[\frac{\frac{(L(x) - L_{ref})}{BL} - \frac{1}{cr}}{1 - \frac{1}{cr}}\right]^{\frac{1}{\gamma}} \tag{5}$$

Here, "cr" represents the panel contrast of the liquid crystal panel 18, and is defined as the ratio between the maximum white luminance and the maximum black luminance in a case where the image display apparatus 10 is illuminated with a certain backlight luminance. Also, "γ" represents a gamma value that is to be used for correcting an input video image and is normally 2.2, and "x" represents a gradation value expressed with eight bits.

A check is then made to determine whether G(x) has been calculated for all the gradation values "x" (step SS107). If the result of the determination is negative, the gradation value "x" is incremented by 1 (step SS108), and G(x) is calculated for the incremented "x" (step SS106). If the result of the determination is positive, the operation moves on to the next step SS109.

In step SS109, the gamma conversion signals G(x) calculated in steps SS106 through SS108 are input to the signal processing unit 16.

Through the steps SS101 through SS109, the gamma conversion signals to be used for gamma conversion are calculated and are input to the signal processing unit 16.

(6) Input Video Signals

An input video image to be input to the signal processing unit 16 may be in one of various formats. In this embodiment however, an input video image that includes the three channels of red, green, and blue is input to the signal processing unit 16, and the signal processing unit 16 performs the gamma conversion on the respective channels, respectively.

(7) Screen Luminance Control Unit 15

Using the light modulation signal input from the adaptation control unit 14, the screen luminance control unit 15 generates the backlight drive signal (a luminance control signal) for actually driving and controlling the backlight 19, and inputs the generated backlight drive signal to the backlight 19 (step S106).

The configuration of the backlight drive signal varies with the type of the light sources provided in the backlight 19. Normally, cold cathode tubes, light emitting diodes (LEDs), or the like are used as the light sources of the backlight 19 of a liquid crystal display apparatus. By controlling the voltage and current to be applied to those light sources, the luminance of those light sources can be modulated.

In general, Pulse Width Modulation (PWM) control to modulate luminance by switching between a light emission period and a light non-emission period at a high speed is used. In this embodiment, LED light sources having emission intensities that are relatively easily controlled are used as the light sources of the backlight 19, and the luminance of the LED light sources are modulated through PWM control. Therefore, using the backlight luminance signal, the backlight driving unit 15 generates a PWM control signal, and inputs the PWM control signal to the backlight 19.

Figure 6:
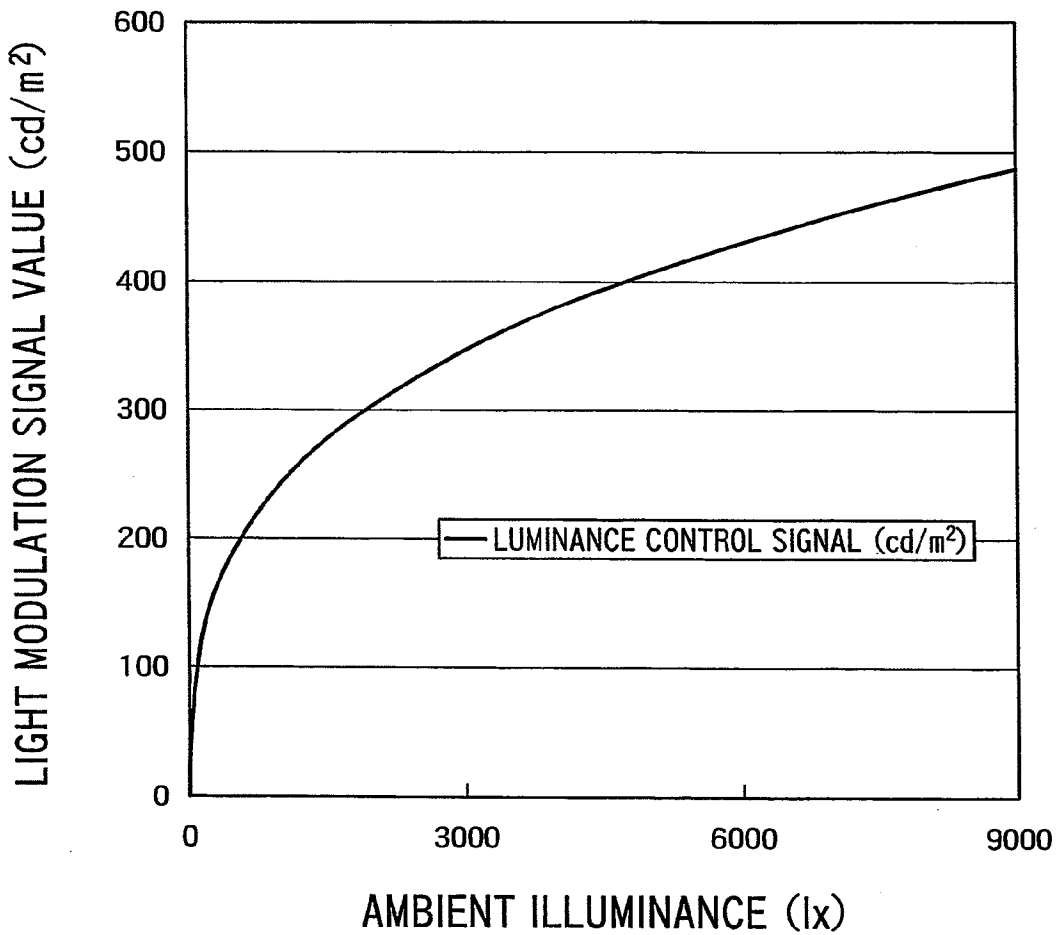
FIG. 6 is a graph showing a luminance control signal for the backlight according to the first embodiment.

As described above, through the steps S101 through S106, the backlight drive signal that is calculated by taking into account the surface reflection and the adaptation of the eye in accordance with the ambient illuminance is input to the backlight 19. FIG. 6 shows the transition of the luminance control signal input to the backlight 19 of this embodiment with respect to the ambient illuminance.

(8) Signal Processing Unit 16

Based on the gamma conversion signals (the gradation conversion functions) input from the adaptation control unit 14, the signal processing unit 16 performs a gamma conversion on the input video image, and inputs the gamma-converted video signals to the liquid crystal panel 18 (step S108). That is, processing according to the following expression (6) is performed on the gradations Y(u, v) of horizontal pixel locations "u" and vertical pixel locations "v" of the input video image:

$$Y_{out}(u,v)=G_{in}(Y(u,v)) \quad (6)$$

Here, "Yout(u, v)" represents the converted gradations of the pixels of the input video image at the locations (u, v). The processing according to the expression (6) is performed on all the pixels in one frame of the input video image, so that video signals are gamma-converted.

The signal processing unit 16 then transmits the gamma-converted video signals to the liquid crystal panel 18.

Through the above described step S108, the gamma-converted video signals are calculated and are input to the liquid crystal panel 18.

Figure 7:
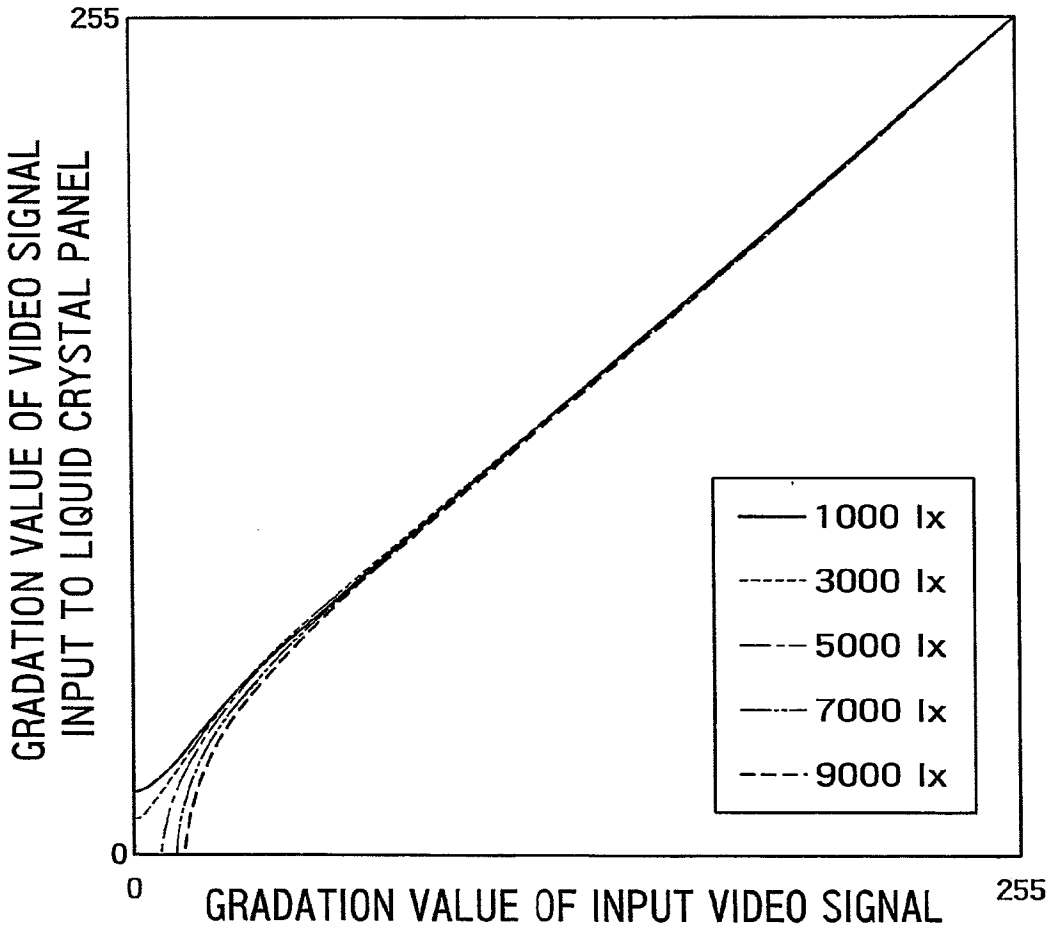
FIG. 7 is a graph showing input gradation values for the liquid crystal panel according to the first embodiment.

As described above, through the steps S101 through S108, video signals converted according to the gamma conversion signals calculated by taking into account the surface reflection and the adaptation amount of the eye in accordance with the ambient illuminance are input to the liquid crystal panel 18. FIG. 7 is a graph (of gamma conversions) showing the corrected gradation values (the gradation values to be input to the liquid crystal panel 18) with respect to the gradation values of the input video signals in the respective ambient illuminance intensities of 1000, 3000, 5000, 7000, and 9000 [lx]. As can be seen from the graph, in the respective ambient illuminance intensities of 1000, 3000, 5000, 7000, and 9000 [lx], the darker gradations are greatly converted. Also, as can be seen from the graph, conversions are performed so that the gradation differences in the darker gradations become larger as the ambient illuminance becomes higher. In view of those factors, an image having the optimum contrast and gradation can be displayed in each of the illuminances.

(9) Image Display Unit 17

The image display unit 17 includes the liquid crystal panel 18 serving as a light modulation device, and the backlight 19 that can modulate the luminance of the light sources (the screen luminance) and is provided on the back side of the liquid crystal panel 18.

In the image display unit 17, converted video signals that are input from the signal processing unit 16 are written into the liquid crystal panel 18 (the light modulation device) (step S109). At the same time, using the backlight drive signal (the luminance control signal) input from the screen luminance control unit 15, the image display unit 17 lights up the backlight 19 (step S107). Thereby, image displaying according to the input video image is performed (step S110). It should be noted that, as described above, LED light sources are used as the light sources of the backlight 19.

(10) Advantageous Effects

As described above, this embodiment can provide the image display apparatus 10 that always displays an excellent visual contrast and gradation in a viewing circumstance where the illuminance suddenly changes.

Second Embodiment

Referring now to FIGS. 8 through 12, an image display apparatus according to a second embodiment is described.

In the retina of the human eye, there exist an infinite number of cells called photoreceptor cells that respond to light that enters the retina. The photoreceptor cells are divided into two kinds called cone cells and rod cells, and output nerve responses in proportion to intensities of light having specific wavelengths. Those nerve responses are transmitted to the visual cortex in the brain in the end, and are recognized as brightness and color shades. Hereinafter, the size of a nerve response output from the cone cells will be referred to as a cone response quantity, and the size of a nerve response output from the rod cells will be referred to as a rod response quantity.

The cone response quantity and the rod response quantity vary with the adaptation amounts of the respective cells. Hereinafter, the adaptation amount of the cone cells will be referred to as a cone adaptation amount, and the adaptation amount of the rod cells will be referred to as a rod adaptation amount. At this point, the cone adaptation amount and the rod adaptation amount become larger as the illuminance becomes higher, and become smaller as the illuminance becomes lower. Alternatively, differences in luminance between bright objects can be more easily recognized when the cone adaptation amount and the rod adaptation amount are larger. Differences in luminance between dark objects can be more easily recognized when the cone adaptation amount and the rod adaptation amount are smaller.

The temporal characteristics vary between the cone adaptation amount and the rod adaptation amount when those amounts increase and decrease with the light intensity in the surroundings. The cone cells relatively quickly increase and decrease with the luminous surroundings, and the rod cells take a longer period of time to increase and decrease than the cone cells. For example, if the surroundings are dark, the cone adaptation amount relatively quickly decreases, and the rod adaptation amount takes a longer period of time to decrease than the cone adaptation amount.

Further, the human eye is said to recognize the brightness of an object by combining the cone response quantity and the rod response quantity with respect to the object. That is, it is possible to correctly estimate the brightness of an object by using the cone response quantity and the rod response quantity.

In view of the above factors, this embodiment uses the cone response quantity and the rod response quantity to calculate brightness as described in the description of the operation performed by the adaptation calculating unit 12 of the first embodiment. To calculate the cone response quantity, a temporal increase or decrease in the cone adaptation amount is estimated. To calculate the rod response quantity, a temporal increase or decrease in the rod adaptation amount is estimated. To calculate the surface reflection luminance, a temporal increase or decrease in the surface reflection luminance is estimated.

Accordingly, the second embodiment can provide an image display apparatus 20 that constantly displays an excellent visual contrast and gradation in a viewing circumstance where the illuminance suddenly changes timewise.

(1) Structure of the Image Display Apparatus 20

Figure 8:
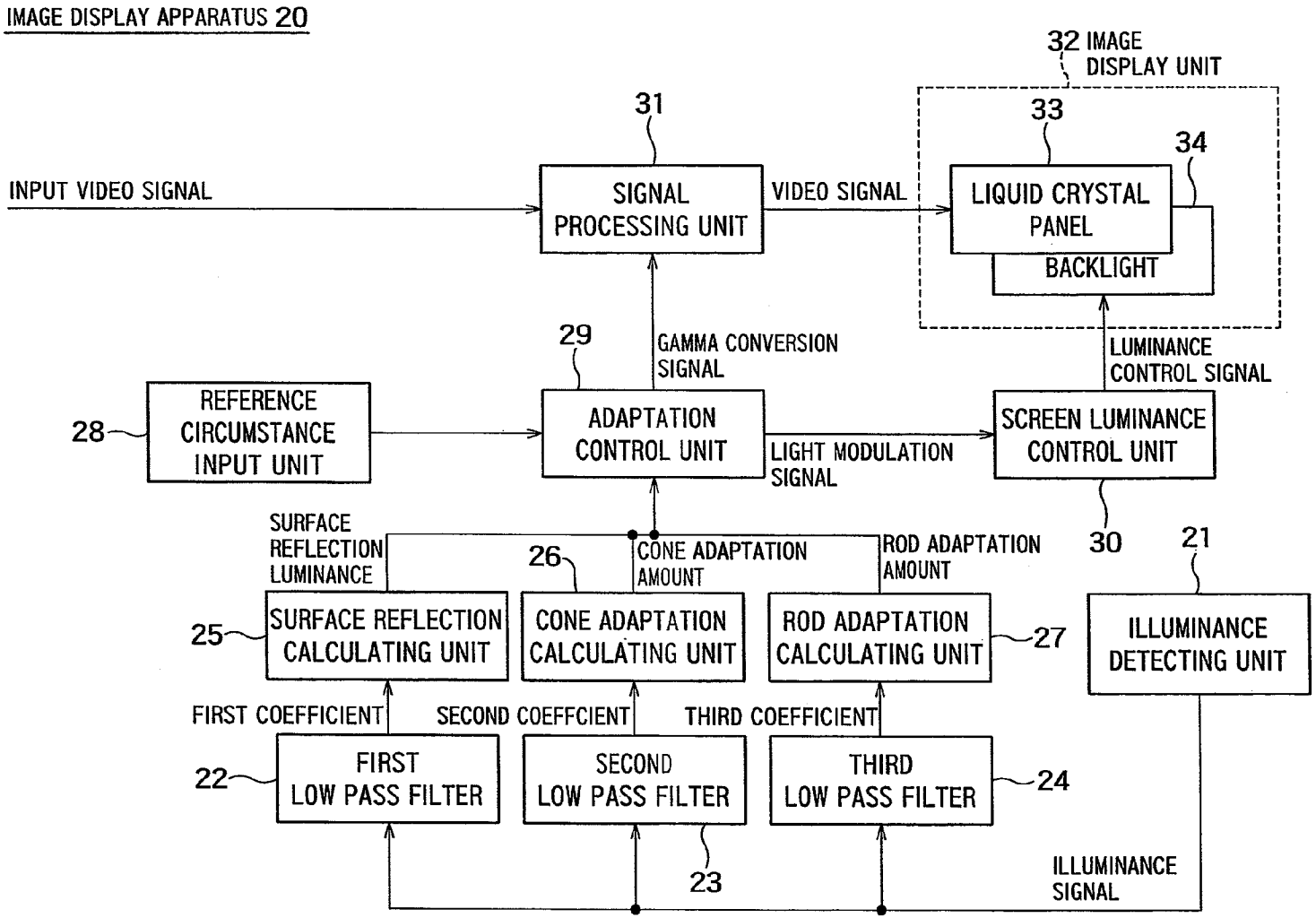
FIG. 8 is a block diagram showing the structure of an image display apparatus according to a second embodiment.

FIG. 8 shows the structure of the image display apparatus 20 according to this embodiment.

The image display apparatus 20 includes an illuminance detecting unit 21, a first temporal low pass filter (hereinafter referred to as a low pass filter) 22, a second low pass filter 23, a third low pass filter 24, a surface reflection calculating unit 25, a cone adaptation calculating unit 26, a rod adaptation calculating unit 27, a reference circumstance input unit 28, an adaptation control unit 29, a screen luminance control unit 30, a signal processing unit 31, and an image display unit 32. The image display unit 32 is a liquid crystal display unit that includes a liquid crystal panel 33 serving as a light modulation device, and a backlight 34 serving as a light source unit provided on the back side of the liquid crystal panel 33.

The illuminance detecting unit 21, the screen luminance control unit 30, the signal processing unit 31, and the image display unit 32 have the same structures as those of the illuminance detecting unit 11, the screen luminance control unit 15, the signal processing unit 16, and the image display unit 17 of the first embodiment, and therefore, detailed explanation of those components are omitted herein.

Using a first low pass filter designed to have an extremely short transition duration (time constant), the first low pass filter 22 performs filtering on an illuminance signal input from the illuminance detecting unit 21, to calculate a first coefficient. The first low pass filter 22 then inputs the first coefficient to the surface reflection calculating unit 25.

Using a second low pass filter designed to have a longer transition duration (time constant) than that of the first low pass filter, the second low pass filter 23 performs filtering on the illuminance signal input from the illuminance detecting unit 21, to calculate a second coefficient. The second low pass filter 23 then inputs the second coefficient to the cone adaptation calculating unit 26.

Using a third low pass filter designed to have a longer transition duration (time constant) than that of the second low pass filter, the third low pass filter 24 performs filtering on the illuminance signal input from the illuminance detecting unit 21, to calculate a third coefficient. The third low pass filter 24 then inputs the third coefficient to the rod adaptation calculating unit 27.

Using the first coefficient input from the first low pass filter 22, the surface reflection calculating unit 25 calculates the luminance of the surface reflection to the display surface of the image display unit 32, and inputs the calculated surface reflection luminance to the adaptation control unit 29.

Using the second coefficient input from the second low pass filter 23, the cone adaptation calculating unit 26 calculates the cone adaptation amount after an illuminance change ("t" seconds after an illuminance change, for example), and inputs the calculated cone adaptation amount to the adaptation control unit 29.

Using the third coefficient input from the third low pass filter 24, the rod adaptation calculating unit 27 calculates the cone adaptation amount after the illuminance change, and inputs the calculated rod adaptation amount to the adaptation control unit 29.

The reference circumstance input unit 28 sets a reference illuminance and a reference screen luminance in an internal storage, based on the initial settings at the time of shipment from the factory or on an external input such as a user input. The reference circumstance input unit 28 then inputs the reference illuminance and the reference screen luminance set therein to the adaptation control unit 29.

Using the reference illuminance E0 and the reference screen luminance L0 input from the reference circumstance input unit 28, the adaptation control unit 29 calculates a brightness function R(x) of a reference circumstance. Using the brightness function R(x), the surface reflection luminance input from the surface reflection calculating unit 25, the cone adaptation amount input from the cone adaptation calculating unit 26, and the rod adaptation amount input from the rod adaptation calculating unit 27, the adaptation control unit 29 calculates a light modulation signal for modulating the backlight luminance, and also calculates gamma conversion signals for a gamma conversion to be performed on an input video image. The adaptation control unit 29 inputs the light modulation signal to the screen luminance control unit 30, and the gamma conversion signals to the signal processing unit 31.

Figure 9:
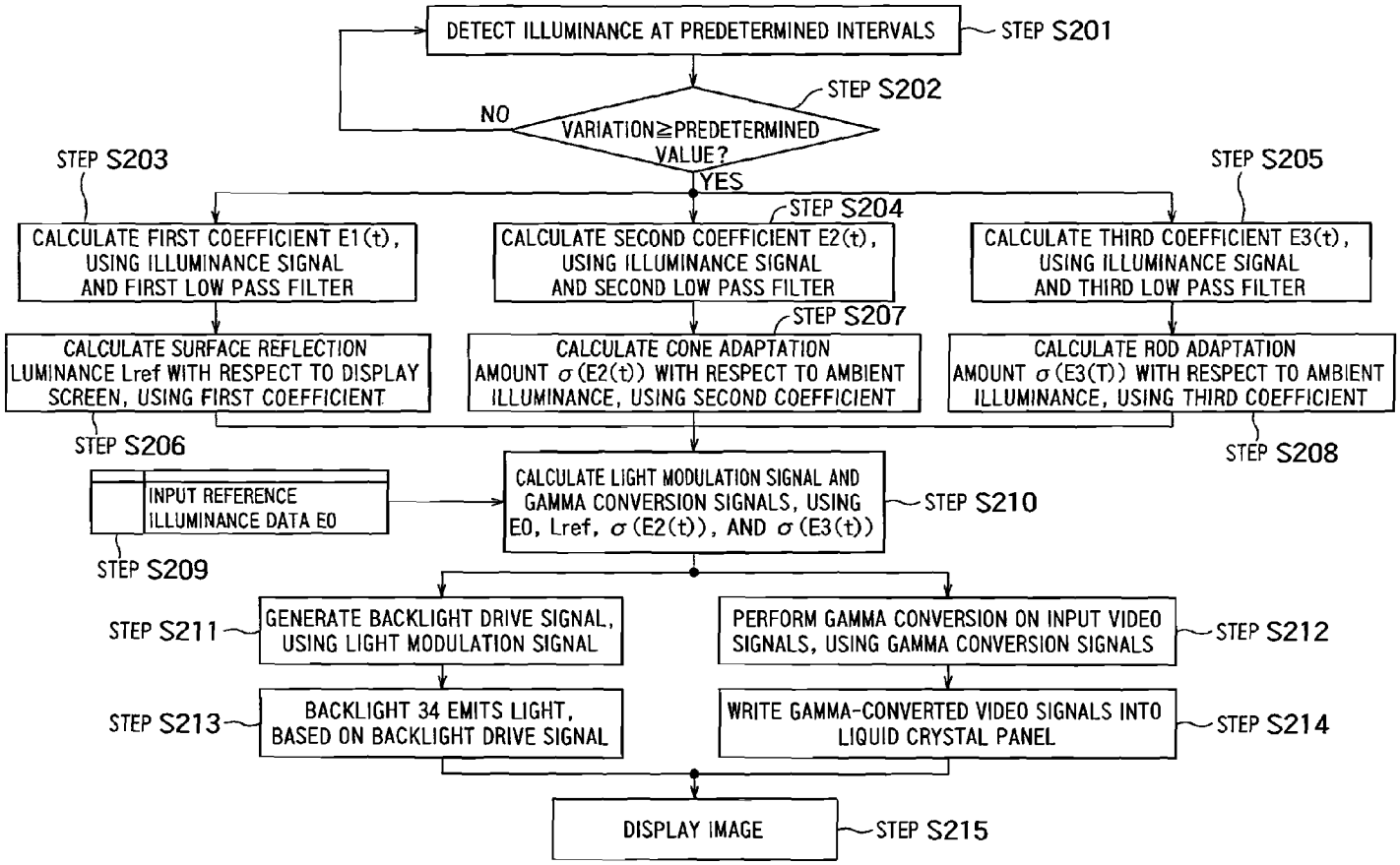
FIG. 9 is a flowchart showing operations of the second embodiment.

Referring now to FIG. 9, operations of the respective components 22 through 29 are described in detail. The procedures of steps S201 and S202 of FIG. 9 are the same as those of steps S101 and S102 of FIG. 2, and therefore, explanation of them is omitted herein.

(2) First Low Pass Filter 22

The first low pass filter 22 is designed to have an extremely short transition duration, and performs filtering on the illuminance signal input from the illuminance detecting unit 21, to calculate the first coefficient E1(*t*). The first low pass filter 22 then inputs the calculated first coefficient E1(*t*) to the surface reflection calculating unit 25 (step S203).

An IIR filter is used as an example of the first low pass filter 22. Here, "E1(*t*)" is calculated according to the following expression (7):

$$E_1(t)=\alpha E_1(t)+(1-\alpha)E_1(t-\Delta t)$$

$$t\leftarrow t+\Delta t \tag{7}$$

Here, "E1(*t*)" represents the coefficient for the point "t" seconds after the illuminance change, and is calculated by using a weighted linear sum of "E1(*t*)" and a coefficient "E1(*t*−Δt)" obtained "Δt" seconds earlier.

Figure 10:
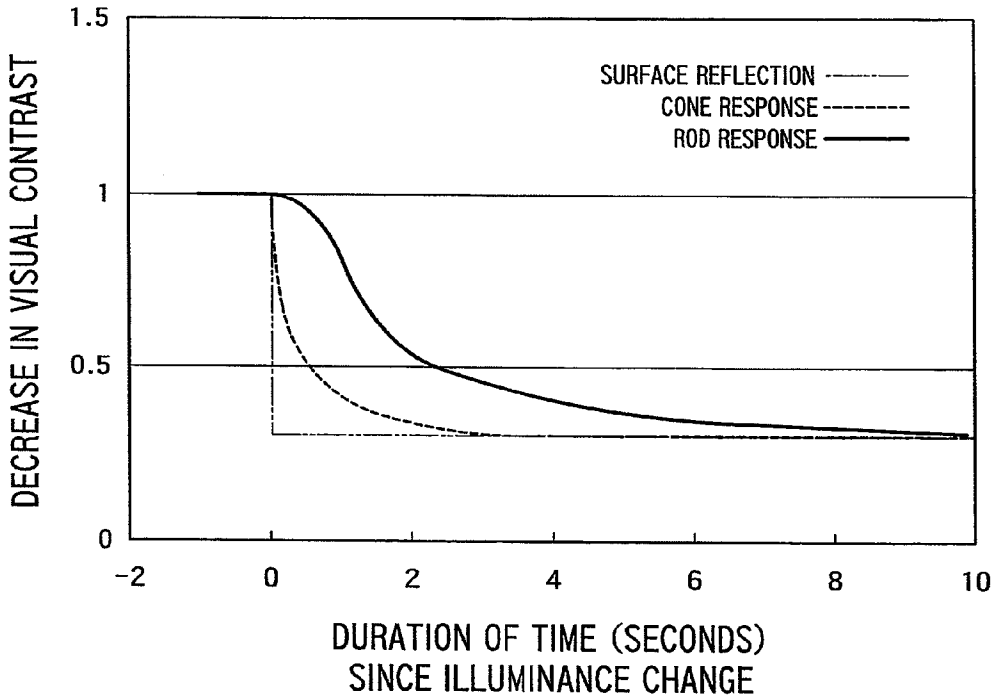
FIG. 10 is a graph showing transient changes in visual contrast in a circumstance where the ambient illuminance suddenly changes according to the second embodiment.

FIG. 10 is a graph showing transient changes in the visual contrast in a circumstance where the ambient illuminance suddenly changes from 4250 lx to 500 lx. As shown in FIG. 10, the transition duration of the change in the visual contrast based on a change in the surface reflection luminance is extremely short, "α" of the expression (7) is preferably set between 0.9 and 1.0.

Through the above described step S203, the first coefficient E1(*t*) indicative of an estimate of a temporal increase or decrease in the surface reflection luminance is calculated and is input to the surface reflection calculating unit 25.

(3) Second Low Pass Filter 23

The second low pass filter 23 is designed to have a longer transition duration than that of the first low pass filter 22, and performs filtering on the illuminance signal input from the illuminance detecting unit 21, to calculate the second coefficient E2(*t*). The second low pass filter 23 then inputs the calculated second coefficient E2(*t*) to the cone adaptation calculating unit 26 (step S204).

An IIR filter is used as an example of the second low pass filter 23. Here, "E2(*t*)" is calculated according to the following expression (8):

$$E_2(t)=\beta E_2(t)+(1-\beta)E_2(t-\Delta t)$$

$$t\leftarrow t+\Delta t \tag{8}$$

Here, "E2(*t*)" represents the coefficient for the point "t" seconds after the illuminance change, and is calculated by using a weighted linear sum of "E2(*t*)" and a coefficient "E2(*t*−Δt)" obtained "Δt" seconds earlier. As shown in FIG. 10, the transition duration of the change in the visual contrast based on a change in the cone adaptation amount is longer than the transition duration of the change in the visual contrast based on a change in the surface reflection luminance, "β" of the expression (8) is preferably set in the range of 0.2 to 0.9. However, as long as "β" is set smaller than "α" determined in the first low pass filter 22, "β" may be set outside the range of 0.2 to 0.9.

Through the above described step S204, the second coefficient E2(*t*) indicative of an estimate of a temporal increase or decrease in the cone adaptation amount is calculated and is input to the cone adaptation calculating unit 26.

(4) Third Low Pass Filter 24

The third low pass filter 24 is designed to have a longer transition duration than that of the second low pass filter 23, and performs filtering on the illuminance signal input from the illuminance detecting unit 21, to calculate the third coefficient E3(*t*). The third low pass filter 24 then inputs the calculated third coefficient E3(*t*) to the rod adaptation calculating unit 27 (step S205).

An IIR filter is used as an example of the third low pass filter 24. Here, "E3(*t*)" is calculated according to the following expression (9):

$$E_3(t)=\epsilon E_3(t)+(1-\epsilon)E_3(t-\Delta t)$$

$$t\leftarrow t+\Delta t \tag{9}$$

Here, "E3(*t*)" represents the coefficient for the point "t" seconds after the illuminance change, and is calculated by using a weighted linear sum of "E3(*t*)" and a coefficient "E3(*t*−Δt)" obtained "Δt" seconds earlier. The transition duration of the change in the visual contrast based on a change in the rod adaptation amount is normally longer than the transition duration of the change in the visual contrast based on a change in the cone response. Therefore, "ϵ" of the expression (9) is preferably set in the range of 0.001 to 0.2. However, as long as "ϵ" is set smaller than "β" determined in the second low pass filter 23, "ϵ" may be set outside the range of 0.001 to 0.2.

Through the above described step S205, the third coefficient E3(*t*) indicative of an estimate of a temporal increase or decrease in the rod adaptation amount is calculated and is input to the rod adaptation calculating unit 27.

(5) Surface Reflection Calculating Unit 25

Using the first coefficient input from the first low pass filter 22, the surface reflection calculating unit 25 calculates the luminance of the surface reflection to the display screen of the image display unit 32, and inputs the calculated surface reflection luminance to the adaptation control unit 29 (step S206). The surface reflection luminance Lref is calculated according to the following expression (10):

$$L_{ref}=\frac{E_1(t)H}{\pi} \tag{10}$$

Here, "E1(*t*)" represents the first coefficient input from the first low pass filter 22, and "H" represents the surface reflectance on the display screen of the image display apparatus 20, and is set between 0 and 1. At this point, "H" is preferably set beforehand at the time of shipment from the factory, but may be changed by user setting.

Through the above described step S206, the surface reflection luminance Lref is calculated and is input to the adaptation control unit 29.

(6) Cone Adaptation Calculating Unit 26

Using the second coefficient input from the second low pass filter 23, the cone adaptation calculating unit 26 calculates a cone adaptation amount to be obtained "t" seconds after the illuminance change, and inputs the calculated cone adaptation amount to the adaptation control unit 29 (step S207). The cone adaptation amount σ(E2(*t*)) is calculated according to the following expression (11):

$$\sigma(E_2(t))=aE_2(t)^{0.33}b \tag{11}$$

Here, "E2(*t*)" represents the second coefficient input from the second low pass filter 23, "a" is a constant that is preferably set between 60.0 and 80.0, and "b" is a constant that is preferably set between 0.5 and 1.5.

Through the above described step S207, the cone adaptation amount σ(E2(*t*)) to be obtained "t" seconds after the illuminance change is calculated and is input to the adaptation control unit 29.

(7) Rod Adaptation Calculating unit 27

Using the third coefficient input from the third low pass filter 24, the rod adaptation calculating unit 27 calculates a rod adaptation amount with respect to the ambient illuminance, and inputs the calculated rod adaptation amount to the adaptation control unit 29 (step S208). The rod adaptation amount σ(E3(*t*)) is calculated according to the following expression (12):

$$\sigma(E_3(t))=\frac{aE_3(t)^{0.33b}}{\lambda} \tag{12}$$

Here, "E3(*t*)" represents the third coefficient input from the third low pass filter 24, "a" is a constant that is preferably set between 60.0 and 80.0, and "b" is a constant that is preferably set between 0.5 and 1.5. Further, "λ" is a constant that is preferably set between 100 and 3000.

Through the above described step S208, the rod adaptation amount σ(E3(*t*)) to be obtained "t" seconds after the illuminance change is calculated and is input to the adaptation control unit 29.

(8) Reference Circumstance Input Unit 28

The reference circumstance input unit 28 inputs the reference illuminance E0 and the reference screen luminance L0 to the adaptation control unit 29 (step S209). As for the reference illuminance E0, the average ambient illuminance in viewing circumstances is preferably set as initial internal storage information at the time of shipment from the factory, but may be rewritten by an external input such as a user operation.

As for the reference screen luminance L0, the optimum screen luminance under the reference illuminance E0 is preferably set as initial internal storage information at the time of shipment from the factory, but may be rewritten by an external input such as a user operation.

In the procedures in the adaptation control unit 29 and the later stages, adaptation control is performed on the basis of the reference illuminance E0 and the reference screen luminance L0 set in the reference circumstance input unit 28.

Therefore, by setting various parameters in accordance with circumstances where the image display apparatus 20 is viewed, more precise and detailed adaptation control can be performed.

(9) Adaptation Control Unit 29

Using the reference illuminance E0 and the reference screen luminance L0 input from the reference circumstance input unit 28, the adaptation control unit 29 calculates the brightness function R(x) of the reference circumstance. Using the brightness function R(x) of the reference circumstance, the surface reflection luminance Lref input from the surface reflection calculating unit 25, the cone adaptation amount σ(E2(*t*)) input from the cone adaptation calculating unit 26, and the rod adaptation amount σ(E3(*t*)) input from the rod adaptation calculating unit 27, the adaptation control unit 29 calculates the light modulation signal for modulating the luminance of the backlight 34, and gamma conversion signals for a gamma conversion to be performed on input video signals (step S210).

Figure 11:
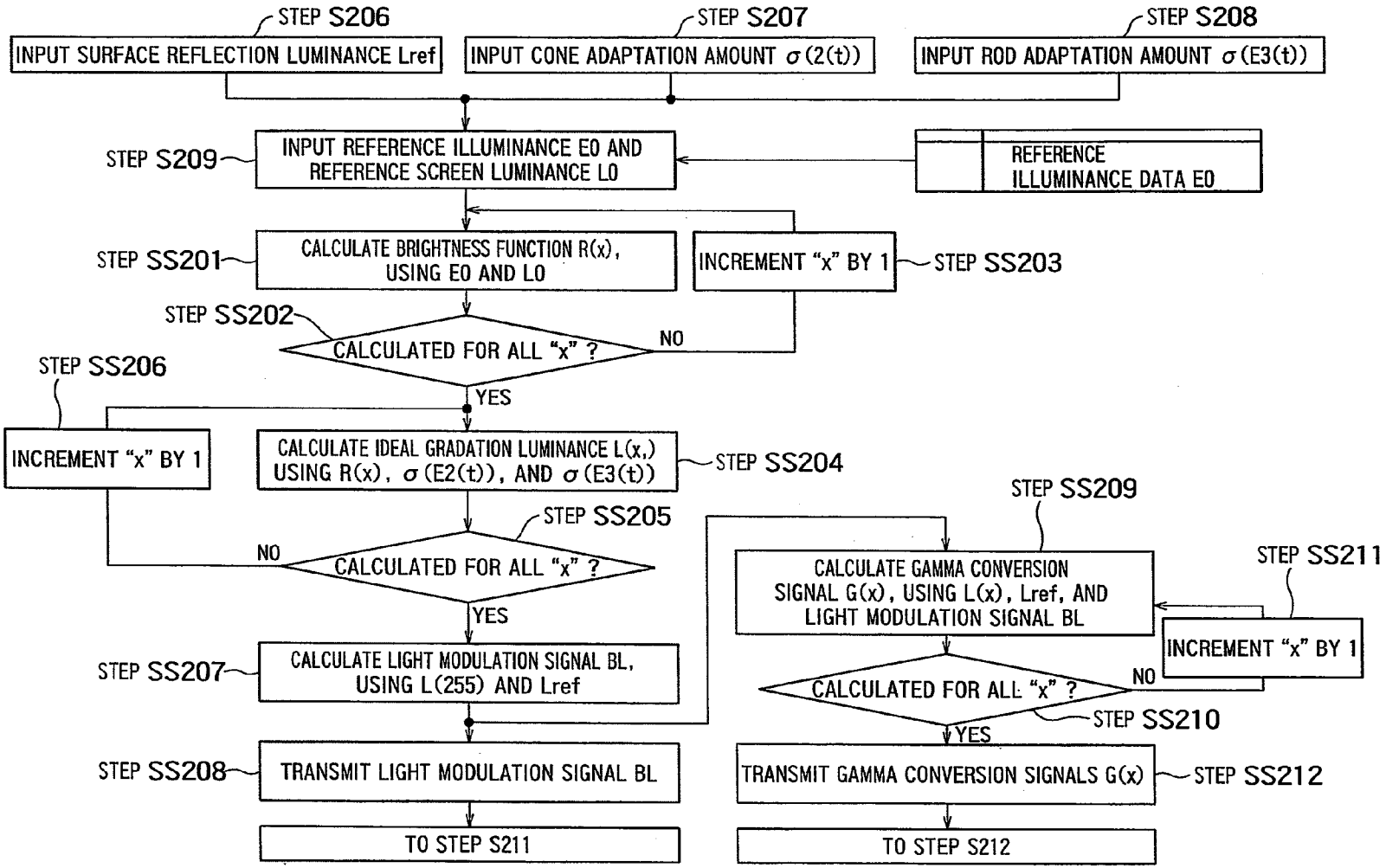
FIG. 11 is a flowchart showing operations to be performed by the adaptation control unit according to the second embodiment.

Referring now to the flowchart shown in FIG. 11, the operations to be performed by the adaptation control unit 29 in step S210 are described.

(9-1) Brightness Function R(x) of the Reference Circumstance

The brightness function R(x) of the reference circumstance holds respective brightness corresponding to respective gradation values in a case where the image display apparatus 20 is illuminated with the reference screen luminance L0 cd/m$^2$ under the reference illuminance E0.

To calculate the brightness function R(x), the display luminance I0(*x*) corresponding to the respective gradation values "x" in a case where the image display apparatus 20 is illuminated with the reference screen luminance L0 cd/m$^2$ under the reference illuminance E0 are first calculated. The cone adaptation amount "σcone" with respect to the ambient illuminance E0 under the reference illuminance E0 is calculated. By using I0(*x*) and "σcone", the cone response quantity "Rcone" is calculated. The rod adaptation amount "σrod" with respect to the ambient illuminance E0 under the reference illuminance E0 is calculated. With use of I0(*x*) and "σrod", the rod response quantity "Rrod" is calculated. Using a weighted linear sum of "Rrod" and "Rcone", the brightness function R(x) of the reference circumstance is calculated (step SS201). In the following, the procedures for calculating the brightness function R(x) are described in detail.

First, in the reference illuminance E01*x*, the reference screen luminance L0 cd/m$^2$ is input to the backlight 34 of the image display apparatus 20, and the display luminance I0(*x*) corresponding to a gradation value "x" is calculated where all the 255 8-bit gradation values are input to the liquid crystal panel 33. The display luminance I0(*x*) is calculated according to the following expression (13):

$$I_0(x) = \left[\left(1 - \frac{1}{cr}\right)\left(\frac{x}{255}\right)^{\gamma} + \frac{1}{cr}\right]L_0 + E_0 H \tag{13}$$

Here, "cr" represents the panel contrast of the liquid crystal panel 33, and is defined as the ratio between the maximum white luminance and the maximum black luminance in a case where the image display apparatus 20 is illuminated with a certain backlight luminance. Also, "γ" represents a gamma value that is to be used in an inverse correction for the input video image, and is normally 2.2. Further, "x" represents a gradation value expressed with eight bits.

The cone adaptation amount "σcone" with respect to the reference illuminance E0 is then calculated according to the following expression (14):

$$\sigma_{cone} = aE_0^{0.33b} \tag{14}$$

Here, "a" is a constant that is preferably set between 60.0 and 80.0, and "b" is a constant that is preferably set between 0.5 and 1.5.

By using the display luminance I0(*x*) and the cone adaptation amount "σcone", the cone response quantity "Rcone" is calculated according to the following expression (15):

$$\begin{cases} R_{cone} = A\dfrac{I_0(x)^n}{I_0^n + \sigma_{cone}^n} \\ A = \dfrac{s}{s + \sigma_{cone}} \end{cases} \tag{15}$$

Here, "n" is a constant that is preferably set between 0.3 and 2.0, "s" is a constant that is preferably set between 200000 and 500000, and "A" is the weight of the cone adaptation amount "σcone" with respect to the ambient illuminance. If "σcone" becomes larger where "A" is combined with the constant "s", the contribution rate of "Rcone" becomes lower.

The rod adaptation amount "σrod" with respect to the reference illuminance E0 is then calculated according to the following expression (16):

$$\sigma_{rod} = \frac{aE_0^{0.33b}}{\tau} \tag{16}$$

Here, "a" is a constant that is preferably set between 60.0 and 80.0, "b" is a constant that is preferably set between 0.5 and 1.5, and "τ" is a constant that is preferably set between 100 and 3000.

By using the display luminance 10 and the rod adaptation amount "σrod", the rod response quantity "Rrod" is calculated according to the following expression (17):

$$\begin{cases} R_{rod} = B\dfrac{I_0(x)^n}{I_0(x)^n + \sigma_{rod}^n} \\ B = \dfrac{g}{g + \sigma_{rod}} \end{cases} \tag{17}$$

Here, "n" is a constant that is preferably set between 0.3 and 2.0, "g" is a constant that is preferably set between 0.001 and 0.5, and "B" is the weight of the rod adaptation amount "σrod" with respect to the ambient illuminance. If "σrod" becomes larger where "B" is combined with the constant "g", the contribution rate of "Rrod" becomes lower.

By using the rod response quantity "Rrod", the cone response quantity "Rcone", the weight A, and the weight B, the brightness function R(x) of the reference circumstance is calculated. The brightness function R(x) of the reference circumstance is calculated according to the following expression (18):

$$R(x) = \frac{R_{rod} + R_{cone}}{A + B} \tag{18}$$

A check is then made to determine whether R(x) has been calculated for all the gradations values "x" (step SS202). If the result of the determination is negative, the gradation value "x" is incremented by 1 (step SS203), and R(x) is calculated for the incremented "x" (step SS201). If the result of the determination is positive, the operation moves on to the next step SS204.

Through the described steps SS201 through SS203, the brightness function R(x) of the reference circumstance is calculated.

(9-2) Ideal Gradation Luminances L(x)

Using the brightness function R(x) of the reference circumstance, the cone adaptation amount σ(E2(*t*)) input from the cone adaptation calculating unit 26, and the rod adaptation amount σ(E3(*t*)) input from the rod adaptation calculating unit 27, the adaptation control unit 29 calculates an ideal gradation luminance L(x) (step SS204).

Each ideal gradation luminance L(x) is calculated according to the following expression (19):

$$\begin{aligned} L(x)=&((-(R(x)\times((s/(s+\sigma(E3(t))))+(g/(g+\sigma(E3(t)))))\times(\sigma(E2(t))^n+\sigma(E3(t))^n)+\sigma(E3(t))^n+\sigma(E2(t))^n\times(g/(g+\sigma(E3(t)))))-((((R(x)\times((s/(s+\sigma(E3(t))))+(g/(g+\sigma(E3(t)))))\times(\sigma(E2(t))^n+\sigma(E3(t))^n)-\sigma(E3(t))^n-\sigma(E2(t))^n\times(g/(g+\sigma(E3(t)))))\times((R(x)\times((s/(s+\sigma(E3(t))))+(g/(g+\sigma(E3(t)))))\times(\sigma(E2(t))^n+\sigma(E3(t))^n)-\sigma(E3(t))^n-\sigma(E2(t))^n\times(g/(g+\sigma(E3(t)))))-4\times\sigma(E2(t))^n\times\sigma(E3(t))^n\times(R(x)\times((s/(s+\sigma(E3(t))))+(g/(g+\sigma(E3(t)))))\times((R(x)\times((s/(s+\sigma(E3(t))))+(g/(g+\sigma(E3(t))))-(g/(g+\sigma(E3(t))))-1))))^{0.5})/(2\times((R(x)\times((s/(s+\sigma(E3(t))))+(g/(g+\sigma(E3(t)))))-(g/(g+\sigma(E3(t))))-1)) \end{aligned} \tag{19}$$

Here, "g" is a constant that is preferably set between 0.001 and 0.5, "s" is a constant that is preferably set between 200000 and 500000, and "n" is a constant that is preferably set between 0.3 and 2.0.

The above described expression (19) is equivalent to solving the following equations (20) in terms of L(x), or is equivalent to determining the ideal gradation luminance L(x) required to achieve the brightness equal to the brightness function R(x) of the reference circumstance in a case where the cone adaptation amount σ(E2(*t*)) and the rod adaptation amount σ(E3(*t*)) are known.

$$\begin{aligned} R(x) &= f(L(x), \sigma(E_2(t)), \sigma(E_3(t))) = \frac{R_{rod} + R_{cone}}{A + B} \\ R_{cone} &= A\frac{L(x)^n}{L(x)^n + \sigma(E_2(t))^n}, \\ R_{rod} &= B\frac{L(x)^n}{L(x)^n + \sigma(E_3(t))^n} \\ A &= \frac{s}{s + \sigma(E_2(t))}, \\ B &= \frac{g}{g + \sigma(E_3(t))} \end{aligned} \tag{20}$$

Therefore, arithmetic operations using an expression other than the expression (19) may be performed, as long as the ideal gradation luminance L(x) is calculated by using the brightness function R(x) of the reference circumstance, the cone adaptation amount σ(E2(*t*)), and the rod adaptation amount σ(E3(*t*)).

A check is then made to determine whether L(x) has been calculated for all the gradations values "x" (step SS205). If the result of the determination is negative, the gradation value "x" is incremented by 1 (step SS206), and L(x) is calculated for the incremented "x" (step SS204). If the result of the determination is positive, the operation moves on to the next step SS207.

Through the above described steps SS204 through SS206, the ideal gradation luminance L(x) are calculated.

(9-3) Light Modulation Signal BL

By using L(255), which is the maximum luminance of the calculated ideal gradation luminance L(x), and the surface reflection luminance Lref, which is output from the surface reflection calculating unit 25, the light modulation signal BL is calculated (step SS207). The light modulation signal BL is calculated by subtracting Lref from L(255). At this point, the light modulation signal BL is calculated according to the following expression (21):

$$BL = L(255) - L_{ref} \tag{21}$$

The light modulation signal BL calculated in step SS207 is then input to the screen luminance control unit 30.

Through the above described steps SS201 through SS207, the light modulation signal BL for modulating the luminance of the backlight 34 is calculated and is input to the screen luminance control unit 30.

(9-4) Gamma Conversion Signals G(x)

By using the light modulation signal BL calculated in step SS207, the ideal gradation luminance L(x) calculated in steps SS204 through SS206, and the surface reflection luminance Lref calculated by the surface reflection calculating unit 25, gamma conversion signals G(x) are calculated (step SS209).

A gamma conversion signal G(x) associates an input gradation value "x" with a gradation value with which the luminance obtained by subtracting the surface reflection luminance Lref from the ideal gradation luminance L(x) of the input gradation value "x" is displayed on the image display apparatus 20.

Each gamma conversion signal G(x) is obtained according to the following expression (22):

$$G(x) = 255\left[\frac{\frac{(L(x) - L_{ref})}{BL} - \frac{1}{cr}}{1 - \frac{1}{cr}}\right]^{\frac{1}{\gamma}} \tag{22}$$

Here, "cr" represents the panel contrast of the liquid crystal panel 33, and is defined as the ratio between the maximum white luminance and the maximum black luminance in a case where the image display apparatus 20 is illuminated with a certain backlight luminance. Also, "γ" represents a gamma value that is to be used for correcting an input video image and is normally 2.2, and "x" represents a gradation value expressed with eight bits.

A check is then made to determine whether G(x) has been calculated for all the gradation values "x" (step SS210). If the result of the determination is negative, the gradation value "x" is incremented by 1 (step SS211), and G(x) is calculated for the incremented "x" (step SS209). If the result of the determination is positive, the gamma conversion signals G(x) are input to the signal processing unit 31 (step SS212).

Through the steps SS201 through SS212, the gamma conversion signals to be used for the gamma conversion are calculated and are input to the signal processing unit 31.

(10) Advantageous Effects

The second embodiment can provide the image display apparatus 20 that always displays an excellent visual contrast and gradation in a viewing circumstance where the illuminance suddenly changes.

Figure 12:
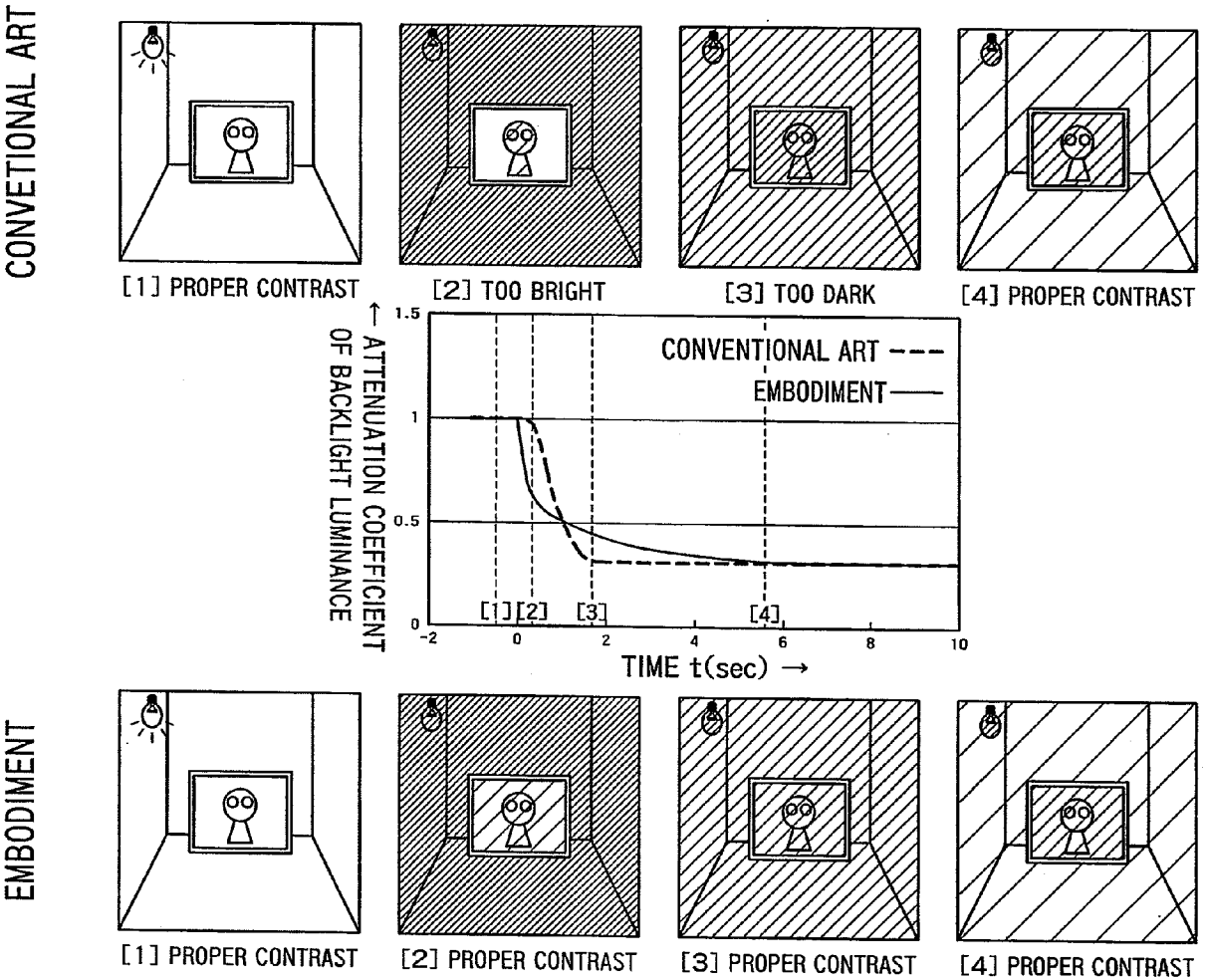
FIG. 12 is a diagram illustrating the advantageous effects of the image display apparatus according to the second embodiment.

Referring now to FIG. 12, the advantageous effects of this embodiment are described. The graph shown in FIG. 12 shows the optimum backlight luminance calculated according to this embodiment taking into account the transient change in visual contrast, and a backlight luminance calculated by a conventional art, in a circumstance where the ambient illuminance suddenly changes from 4250 lx to 500 lx. In FIG. 12, the abscissa axis indicates the duration of time elapsed since an illuminance change occurred. Here, "t=0" represents the time of occurrence of the illuminance change, a time [1] is a time prior to the occurrence of the illuminance change, and times [2], [3], and [4] are times after the occurrence of the illuminance change.

First, at the time [2] in FIG. 12, surface reflection disappears quickly, and therefore, the visual contrast by the conventional art becomes higher, resulting in a higher brightness than necessary. According to the second embodiment, on the other hand, a backlight luminance that follows changes in visual contrast based on the surface reflection can be set through the operations performed by the surface reflection calculating unit 25 and the adaptation control unit 29. Accordingly, video images with proper contrast can be viewed on the image display apparatus 20.

At the time [3] in FIG. 12, by the conventional art, the visual contrast based on the rod adaptation changes slowly, and the visual contrast becomes lower, resulting in a lower brightness than necessary. According to the second embodiment, on the other hand, a backlight luminance that follows the slow changes in visual contrast based on the cone adaptation and the rod adaptation can be set through the operations performed by the cone adaptation calculating unit 26, the rod adaptation calculating unit 27, and the adaptation control unit 29. Accordingly, video images with proper contrast can be viewed on the image display apparatus 20.

At the time [4] after a sufficient period of time has passed, proper contrast is achieved both by the conventional art and this embodiment.

As described above, according to the second embodiment, by virtue of the operations performed by the surface reflection calculating unit 25, the cone adaptation calculating unit 26, the rod adaptation calculating unit 27, and the adaptation control unit 29, video images with proper contrast are displayed even when the ambient brightness changes suddenly, and video images with accurate and proper contrast can be displayed over a long period of time.

In this embodiment, the adaptation amount of the eye is divided into the cone adaptation amount and the rod adaptation amount, and operations are performed by taking into account the temporal characteristics of the cone adaptation amount and the rod adaptation amount. However, this embodiment may be applied to the first embodiment. In that case, the adaptation amount of the eye is not divided into the cone adaptation amount and the rod adaptation amount, and operations may be performed by taking into account the temporal characteristics of the adaptation amount of the eye that combine the characteristics of the cone adaptation amount and the rod adaptation amount. The low pass filter that is used in that case might have a time constant that is larger than that of the second low pass filter and is smaller than that of the third low pass filter.

Third Embodiment

Figure 13:
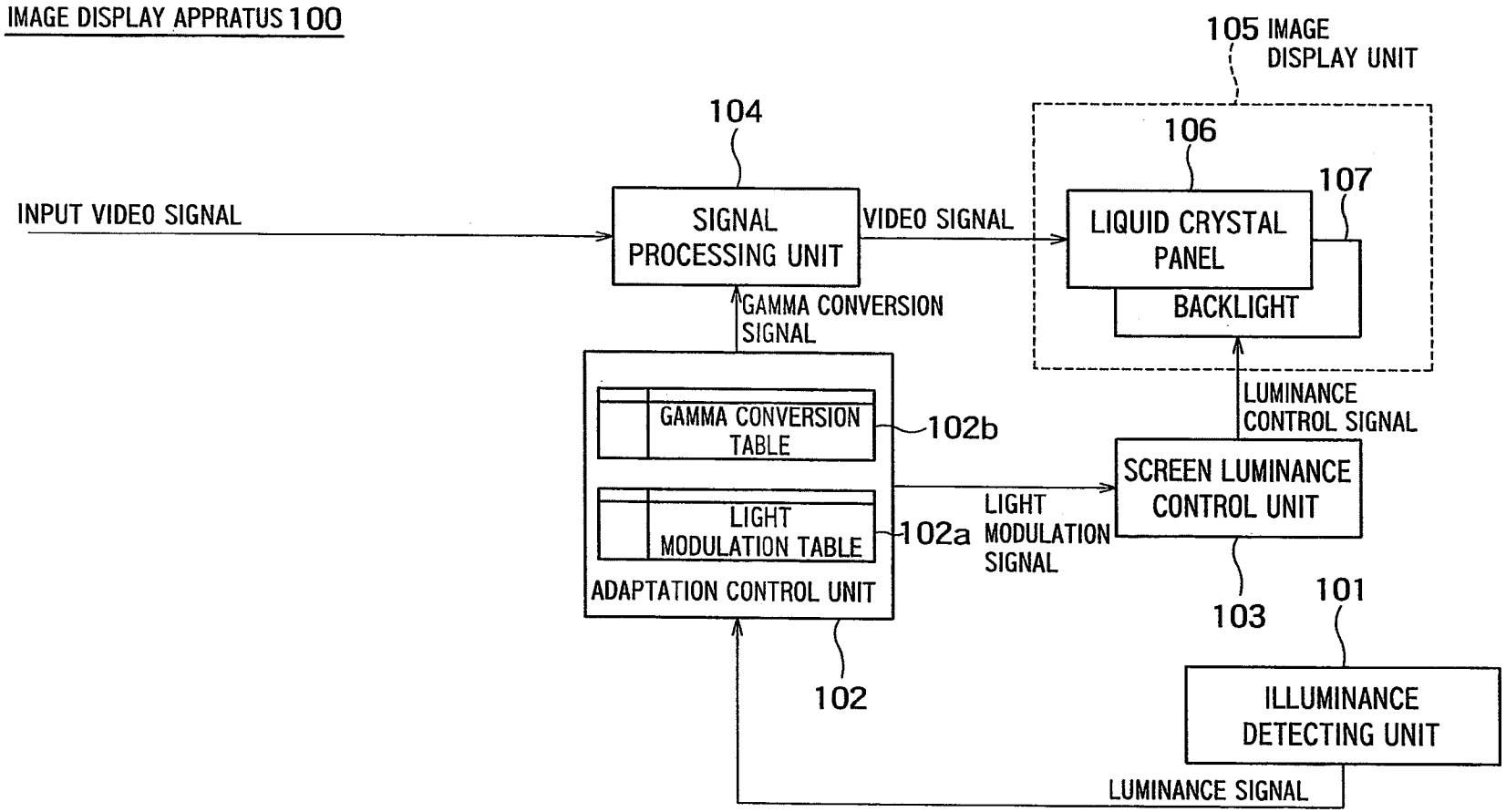
FIG. 13 is a block diagram showing the structure of an image display apparatus according to a third embodiment.

Referring now to FIGS. 13 through 15, an image display apparatus according to a third embodiment is described.

FIG. 13 shows the structure of an image display apparatus 100 according to this embodiment.

This embodiment is characterized in that the image display apparatus 100 acquires a light modulation signal and a gamma conversion signal for each illuminance by calculating beforehand the operations of the adaptation control unit 14 according to the first embodiment and the adaptation control unit 29 according to the second embodiment, on respective illuminances, and stores those signals as table data beforehand into an adaptation control unit 102.

The image display apparatus 100 includes an illuminance detecting unit 101, the adaptation control unit 102, a screen luminance control unit 103, a signal processing unit 104, and an image display unit 105. The image display unit 105 is a liquid crystal display unit that includes a liquid crystal panel 106 serving as a light modulation device, and a backlight 107 serving as a light source unit provided on the back side of the liquid crystal panel 106.

The illuminance detecting unit 101, the screen luminance control unit 103, the signal processing unit 104, and the image display unit 105 have the same structures as those of the illuminance detecting unit 11, the screen luminance control unit 15, the signal processing unit 16, and the image display unit 17 of the image display apparatus 10 according to the first embodiment, and the illuminance detecting unit 21, the screen luminance control unit 30, the signal processing unit 31, and the image display unit 32 of the image display apparatus 20 according to the second embodiment. Therefore, detailed explanation of those components is omitted herein.

In the following, the adaptation control unit 102 is described in detail.

The adaptation control unit 102 includes a light modulation signal table 102*a* that holds optimum light modulation signals for respective illuminances, and a gamma conversion signal table 102*b* that holds optimum gamma conversion signals for respective illuminances.

FIG. 14 shows an example of the light modulation signal table 102*a*. The table 102*a* of FIG. 14 holds the optimum light modulation signals for ambient illuminance intensities 80 lx to 9000 lx. The light modulation signal table 102*a* is acquired by calculating beforehand the same operations as those of the adaptation control unit 14 according to the first embodiment and the adaptation control unit 29 according to the second embodiment, on the respective illuminances.

FIG. 15 shows an example of the gamma conversion signal table 102*b*. The table 102*b* of FIG. 15 holds the optimum gamma conversion signals for ambient illuminance intensities 1000 lx to 9000 lx wherein the optimum gamma conversion signals corresponds to columns in the table. The gamma conversion signal table 102*b* is acquired by calculating beforehand the same operations as those of the adaptation control unit 14 according to the first embodiment and the adaptation control unit 29 according to the second embodiment, on the respective illuminances.

Based on an illuminance signal input from the illuminance detecting unit 101, the adaptation control unit 102 refers to the light modulation signal table 102*a* to identify the corresponding light modulation signal, and inputs the identified light modulation signal to the screen luminance control unit 103. Based on the above described illuminance signal, the adaptation control unit 102 also refers to the gamma conversion signal table 102*b* to identify the corresponding gamma conversion signal, and outputs the identified gamma conversion signal to the signal processing unit 104.

As described above, the third embodiment can provide the image display apparatus 100 that greatly lowers the processing costs (the processing time and calculations) of the adaptation control unit 102, and operates at high speeds, by calculating beforehand the adaptation control operations and acquiring the table data beforehand.

The present invention is not limited to the exact embodiments described above and can be embodied with its components modified in an implementation phase without departing from the scope of the invention. Also, arbitrary combinations of the components disclosed in the above-described embodiments can form various inventions. For example, some of the all components shown in the embodiments may be omitted. Furthermore, components from different embodiments may be combined as appropriate.

The invention claimed is:

1. An image display apparatus comprising:

an image display unit to display an image on a display area;

an illuminance detecting unit configured to detect an ambient illuminance of the image display unit;

a backlight unit to emit a light;

an adaptation calculating unit configured to calculate an adaptation amount of an eye, based on the ambient illuminance;

a surface reflection calculating unit configured to calculate a light reflection luminance on the display area, based on the ambient illuminance;

an adaptation control unit which calculates ideal gradation luminance for a plurality of gradations, respectively, based on the adaptation amount of the eye, the ideal gradation luminance being indicative of display luminance necessary to achieve predetermined brightness at the ambient illuminance; and calculates a first screen luminance being a screen luminance to be set on the backlight unit, based on the reflection luminance;

a luminance setting unit configured to set a light luminance based on the first screen luminance; and a signal processing unit configured to convert gradations of an input video signal based on differences between the reflection luminance and the ideal gradation luminance corresponding to the gradations, wherein:

the image display unit displays the image, based on the video signal converted by the signal processing unit; and the back light unit emits light in accordance with the first screen luminance.

2. The apparatus according to claim 1, further comprising:

a first filtering unit configured to perform filtering on a value of the ambient illuminance to calculate a first coefficient wherein the first filtering unit has a first time constant; and a second filtering unit configured to perform filtering on the value of the ambient illuminance to calculate a second coefficient, wherein the second filtering unit has a second time constant longer than the first time constant, wherein:

the surface reflection calculating unit calculates the reflection luminance, based on the first coefficient, and the adaptation calculating unit calculates the adaptation amount of the eye, based on the second coefficient.

3. The apparatus according to claim 2, further comprising:

a third filtering unit configured to perform filtering on the value of the ambient illuminance to calculate a third coefficient, wherein the third filtering unit has a third time constant longer than the second time constant, wherein:

the adaptation calculating unit comprises:

a cone adaptation calculating unit to calculate a cone adaptation amount with respect to the ambient illuminance, based on the second coefficient; and a rod adaptation calculating unit to calculate a rod adaptation amount with respect to the ambient illuminance, based on the third coefficient, and the first luminance calculating unit of the adaptation control unit calculates the ideal gradation luminance for the gradations, respectively, based on the cone adaptation amount and the rod adaptation amount.

4. The apparatus according to claim 3, wherein:

the adaptation control unit includes:

a first table holding a plurality of ambient illuminance and respective screen luminance corresponding to the ambient illuminance; and a second table holding a plurality of ambient illuminance and respective gradation conversion functions corresponding to the ambient illuminance, the screen luminance setting unit determines the first screen luminance to be a screen luminance corresponding to the ambient illuminance detected by the illuminance detecting unit based on the first table, and the signal processing unit identifies a gradation conversion function corresponding to the ambient illuminance detected by the illuminance detecting unit based on the second table, and performs a gradation conversion on the input video signal according to the identified gradation conversion function.

* * * * *